US005784080A

United States Patent [19]

Nitta et al.

[11] Patent Number: 5,784,080

[45] Date of Patent: Jul. 21, 1998

[54] SERIAL PRINTER WHICH PERFORMS AN INITIALIZING OPERATION AFTER A WAITING TIME HAS ELASPSED

[75] Inventors: Noboru Nitta; Akira Oda, both of Shizuoka, Japan

[73] Assignee: Kabushiki Kaisha Tec, Tokyo, Japan

[21] Appl. No.: 559,249

[22] Filed: Nov. 16, 1995

[30] Foreign Application Priority Data

Nov. 17, 1994 [JP] Japan ..... 6-283093

[51] Int. Cl.[6] ..... B41J 2/165; B41J 29/38

[52] U.S. Cl. ..... 347/23; 347/5

[58] Field of Search ..... 347/23, 29, 30, 347/35, 60, 5, 118

[56] References Cited

U.S. PATENT DOCUMENTS

| | | | |
|---|---|---|---|
| 4,926,196 | 5/1990 | Mitzoguchi et al. | 347/23 |
| 5,341,163 | 8/1994 | Hanabusa | 347/23 |
| 5,359,358 | 10/1994 | Shimamura et al. | 347/9 |
| 5,475,404 | 12/1995 | Takahashi et al. | 347/23 |

FOREIGN PATENT DOCUMENTS

| | | | |
|---|---|---|---|
| 5-32010 | 2/1993 | Japan | 347/23 |
| 5-84926 | 4/1993 | Japan | 347/23 |
| 5-220967 | 8/1993 | Japan | 347/23 |
| 7-76092 | 3/1995 | Japan | 347/23 |
| 62-158051 | 7/1997 | Japan | 347/23 |

*Primary Examiner*—Peter S. Wong
*Assistant Examiner*—Gregory J. Toatley, Jr.
*Attorney, Agent, or Firm*—Cushman Darby & Cushman IP Group of Pillsbury Madison & Sutro LLP

[57] ABSTRACT

A serial printer includes a printing unit for carrying a print head, a DC power unit for generating a DC drive voltage to drive a carriage motor of the printing unit, and a control unit for performing an initializing operation. In this initializing operation, the print head is moved in reciprocal directions when the initialization request signal from the host apparatus is received by the printer, but only after the elapse of a waiting time corresponding to an attenuating period of the DC voltage. This control sequence avoids the performance of an initializing operation by the printer when the initialization request signal has been issued by the host apparatus as the DC voltage is attenuating, such as when power is being shut off, so that the printer would remain engaged for an insufficient time to complete the initializing operation.

18 Claims, 3 Drawing Sheets

SERIAL PRINTER WHICH PERFORMS AN INITIALIZING OPERATION AFTER A WAITING TIME HAS ELASPSED

BACKGROUND OF THE INVENTION

1. Field of the Invention

This invention relates, in general, to printers connected to an external host apparatus to in order to print out data from the external host apparatus. In particular, the invention relates to a serial printer including a print head and a carriage for carrying the print head along with a guide so as to print characters and/or graphics.

2. Description of the Related Art

The general class of serial printer includes impact dot printers and non-impact dot printers. Impact dot printers include wire dot printers, and. Non-impact dot printers include ink jet printers. Ink jet printers are widely used because of their silent operation; these jet printers are provided with an ink jet head which ejects ink in response to image signals. Ink jet printers are connected to an external host apparatus, e.g., a personal computer, to effect a printing operation based on the print data received from the host apparatus. Before beginning of the printing operation, the printer performs an initializing operation in response to an initialization request signal from the host apparatus.

As shown in FIG. 1, a conventional ink jet printer 11 is connected to a personal computer 13 through a print data transmission line 15 and an initialization request signal transmission line 17. Ink jet printer 11 is also connected to personal computer 13 through a power cord 19 to be provided with electric power through computer 13. Data transmission lines (not shown) are also connected between computer 13 and printer 11. Personal computer 13 includes a main body 21, a display 23 and a keyboard (not shown). Main body 21 includes a CPU having a ROM and a RAM, a disc memory drive device and an interface. Personal computer 13 also has a main power cord 25 to be connected to a power source (not shown). A power switch 27 is provided in main body 21 to control the electric power. In this case, electric power is supplied to ink jet printer 11 through personal computer 13 and power cord 19 and is controlled on and off by power switch 27 of main body 21.

When power switch 27 is turned on, electric power is supplied to main body 21 and display 23 through main power cord 25. Electric power is also supplied to ink jet printer 11 through power cord 19. In addition, a DC drive voltage is produced by an AC-DC conversion function of power unit 29 in printer 11 to drive a conventional carriage 31, shown in FIG. 2, by a carriage motor, e.g., a stepping motor (not shown). In response to an initialization request signal from personal computer 13 through initialization request signal transmission line 17, a control section (not shown) of printer 11 performs an initializing operation and then carries out a printing operation based on the print data from computer 13.

Conventional ink jet printer 11 has a maintenance station 31 to prevent an ink jet head 33 from clogging with ink when printer 11 has been left unused for a relatively long period. As shown in FIG. 2, an ink jet cartridge 35 including ink jet head 33 is firmly mounted on carriage 30 which is movable in reciprocal directions indicated by arrows X1 and X2. Maintenance station 31 including a cap 31*a*, an ink receiver 31*b* and a wiper blade 31*c* is located at a prescribed position in printer 11. Wiper block 37 is provided on a rear side (left hand side in FIG. 2) of ink jet head 33.

Before printing, carriage 30 with ink jet head 33 is positioned at a capping position and a conventional maintenance operation is carried out. Ink jet head 33 is moved in the direction X1 to a maintenance position at which ink receiver 31*b* is provided, and ink is jetted from all of the ink jet nozzles of head 33 toward ink receiver 31*b*. After the maintenance operation is carried out, carriage 30 is further moved in the direction X1. The front surface (orifice plate) of ink jet head 33 is brought into contact with wiper blade 31*c*, made of rubber, and ink remaining on the front surface of head 33 is wiped down. As carriage 30 moves further, ink adhered to wiper blade 31c is also removed by wiper block 37 made of sponge. Then, carriage 30 is further moved to locate ink jet head 33 at a standby position (home position) so as to to enhance printing quality and to carry out high speed printing. When ink jet head 33 is located at the standby position, the front surface of ink jet head 33 has been cleaned and clogging has been also cleared from the ink nozzles of head 33. Thus, high quality printing by ink jet printer 11 is ensured.

In the above-described conventional ink jet printer, the maintenance operation is performed by printer 11 in the initializing operation (step ST12), shown in FIG. 3, when the initialization request signal fed from personal computer 13 is received by printer 11 (in step ST11). In the initializing operation, the above-described maintenance operation is firstly carried out and then carriage 30 with ink jet head 33 is moved in reciprocal directions X1 and X2 to smoothly move carriage 30 in the printing operation. On the other hand, when the printing operation (step ST13) is finished, carriage 30 is moved in the direction X2 to locate ink jet head at a capping position at which ink jet head 33 is covered with cap 31*a* to avoid clogging of the ink nozzles of head 33 (step ST14).

However, in a conventional personal computer having a standard specification, the initialization request signal may be issued not only when the electric power of the computer is turned on but also when it is turned off. In conventional ink jet printers, power unit 29 of printer 11 keeps a DC power, which drives carriage 30 through the carriage motor, for a relatively short period (attenuating period) even when the electric power of printer 11 is turned off. The attenuating period is proportional to the capacity of a condenser of power unit 29. In this situation for computer 13 and printer 11, printer 11 automatically begins to carry out the initializing operation if the initialization request signal is issued from computer 13 when the electric power of computer 13 is turned off. However, since the DC power of printer 11 is rapidly decreased for a short time (the attenuating period) when the initializing operation is begun, the initializing operation by printer 11 can not be completed. Thus, carriage 30 is accidentally stopped in the course of the initializing operation. If such an initializing operation is performed incompletely, an operator or a user may perceive erroneously that some trouble is occurring in the printer. In addition, ink jet head 33 may not be capped and may be exposed to the atmosphere, and then clogging with ink may occur in the nozzles of ink jet head 33. Thus, a high quality print may not be achieved in the next printing operation if ink jet head 33 is left without its cap for a relatively long period.

SUMMARY OF THE INVENTION

Accordingly, it is an object of the invention to avoid performance of the initializing operation by a serial printer if an initialization request signal is issued by an external host apparatus with inadequate time to complete the initializing operation.

It is another object of the present invention to achieve a high quality print by a serial printer.

To accomplish the above-described objects, a serial printer includes a printing unit for carrying a print head, a DC power unit for generating a DC drive voltage to drive a carriage motor of the printing unit, and a control unit for performing an initializing operation. In this intializing operation the print head is moved in reciprocal directions when the initialization request signal from the host apparatus is received by the printer, but only direction after the elapse of a waiting time corresponding to an attenuating period of the DC voltage. The printer may include an energizing function for energizing the carriage motor with a holding current from the DC power unit for the waiting time to smoothly drive the carriage motor when a printing operation is begun by the printing unit.

BRIEF DESCRIPTION OF THE DRAWINGS

These and other objects and advantages of this invention will become more apparent and more readily appreciated from the following detailed description of the presently preferred exemplary embodiments of the invention taken in conjunction with accompanying drawings wherein.

DETAILED DESCRIPTION OF THE PREFERRED EMBODIMENT

Figure 1:
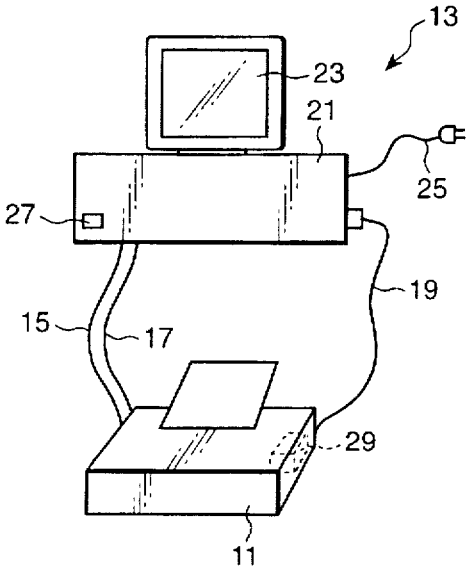
Fig. 1 (PRIOR ART)
FIG. 1 is a view illustrating a construction of a conventional printer and an external host apparatus.

A Preferred embodiment of the present invention will now be described in more detail with reference to the accompanying drawings. However, the same numerals are applied to similar elements in the drawings, and therefore, the detailed descriptions thereof are not repeated.

Figure 2:
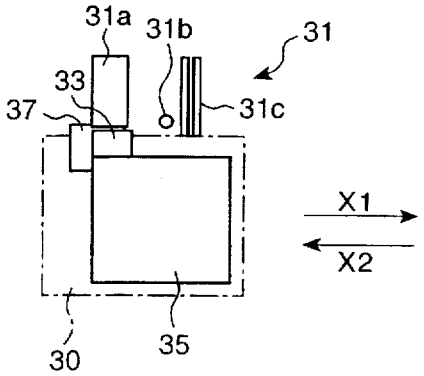
Fig. 2 (PRIOR ART)
FIG. 2 is a shematic view illustrating a printing unit of the conventional printer with a maintenance unit.
Figure 3:
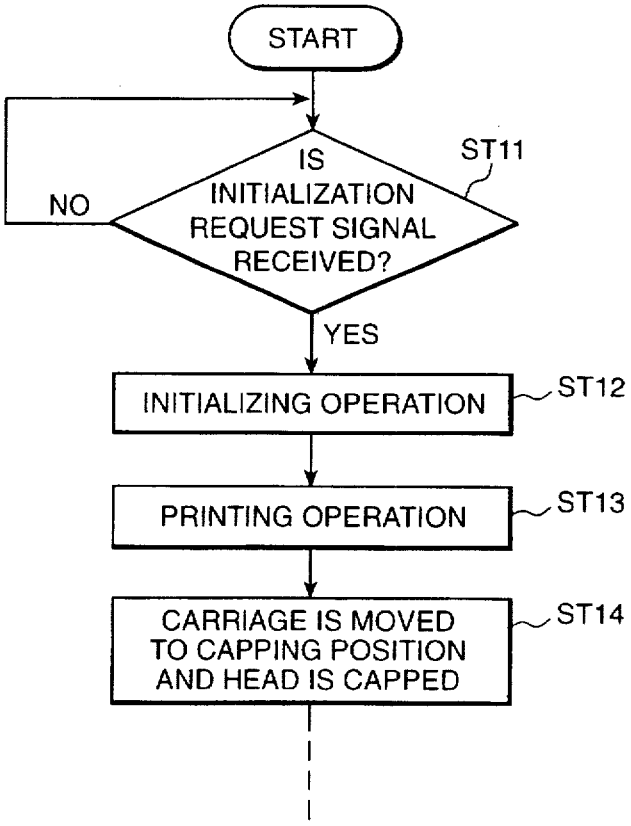
Fig. 3 (PRIOR ART)
FIG. 3 is a flowchart of an operation by the conventional printer.

In this embodiment, a hardware construction including an ink jet printer (serial printer) and a personal computer (external host apparatus) is the same as that shown in FIGS. 1 and 2, and therefore, the system shown in FIGS. 1 and 2 is referenced as a part of the embodiment.

The present invention is applied to an ink jet printer in this embodiment. However, the invention may be applied to other types of serial printers such as an impact dot printer.

Figure 4:
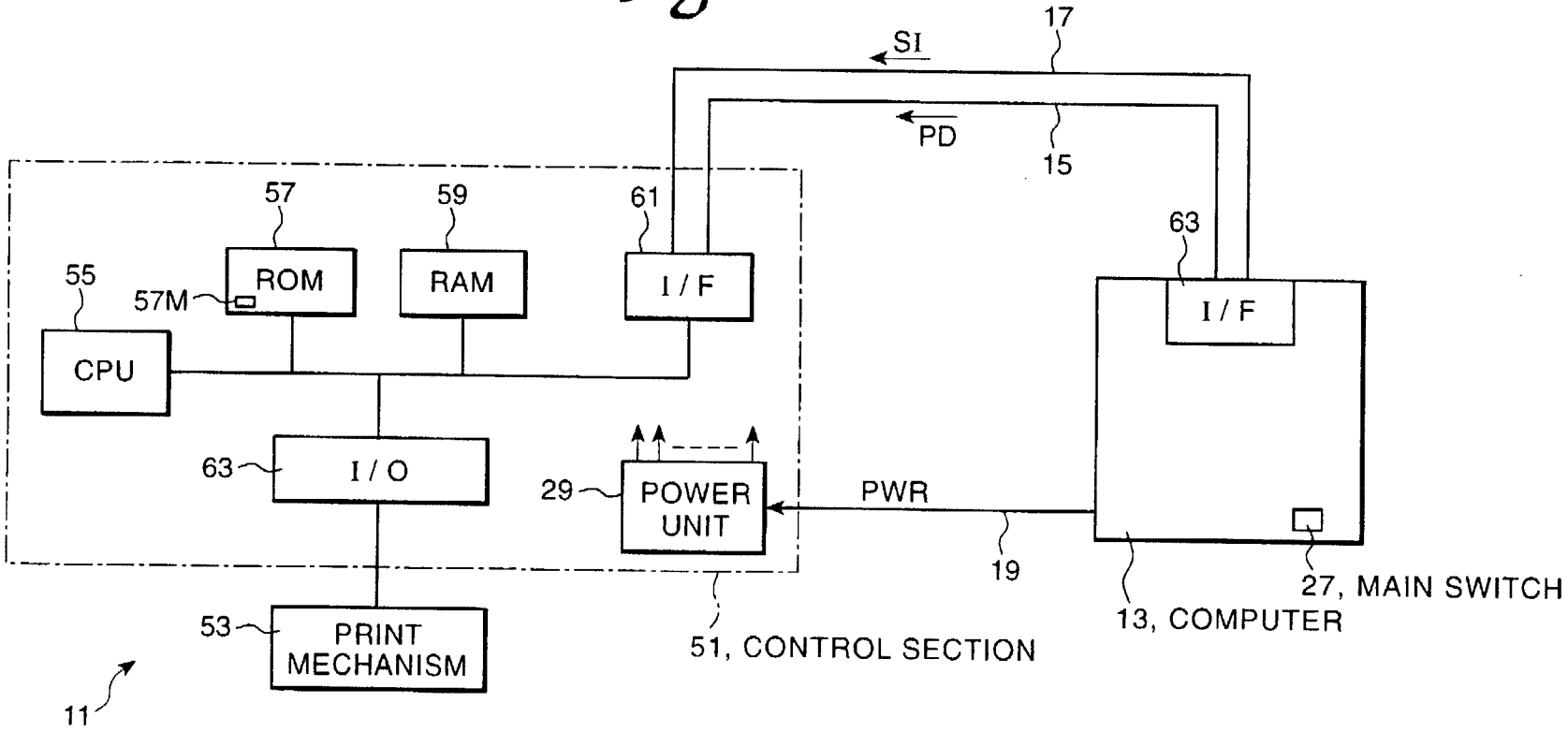
FIG. 4 is a block diagram in a printer of one embodiment of the present invention.

As shown in FIG. 4, an ink jet printer 11 includes a control section 51 and a printing mechanism section 53. Control section 51 includes a CPU 55, a ROM 57, a RAM 59, a parallel interface (I/F) 61, and an input/output port (I/O) 63. ROM 57 stores an operation program of CPU 55, a marking process control program of ink jet head 33 and other operation/control programs of print mechanism 53. RAM 59 provides a working area for CPU 55. Parallel interface 61 is used for receiving data from computer 13 and for sending status signals of printer 11 to computer 13. Input/output port 63 transmits control commands from CPU 55 to print mechanism 53. In this embodiment, a waiting time Ts is also stored in a memory area 57M of ROM 57. The waiting time Ts is substantially the same as an attenuating period of a DC drive voltage maintained after power unit 29 is deactivated. The attenuating period can be measured beforehand and thus the waiting time Ts can also be predetermined. When manufacturing printers, predetermined waiting time Ts is stored in memory area 57M of ROM 57. Waiting time Ts may be stored in RAM 59, instead of memory area 57M of ROM 57. As shown in FIG. 4, personal computer 13 includes a parallel interface 63. Parallel interface 63 of computer 13 is connected to parallel interface 61 of printer 11 through print data transmission line 15 and initialization request signal transmission line 17. Print data PD and status signals are transmitted through data transmission line 15 and initialization request signal SI is transmitted through initialization request signal transmission line 17.

Figure 5:
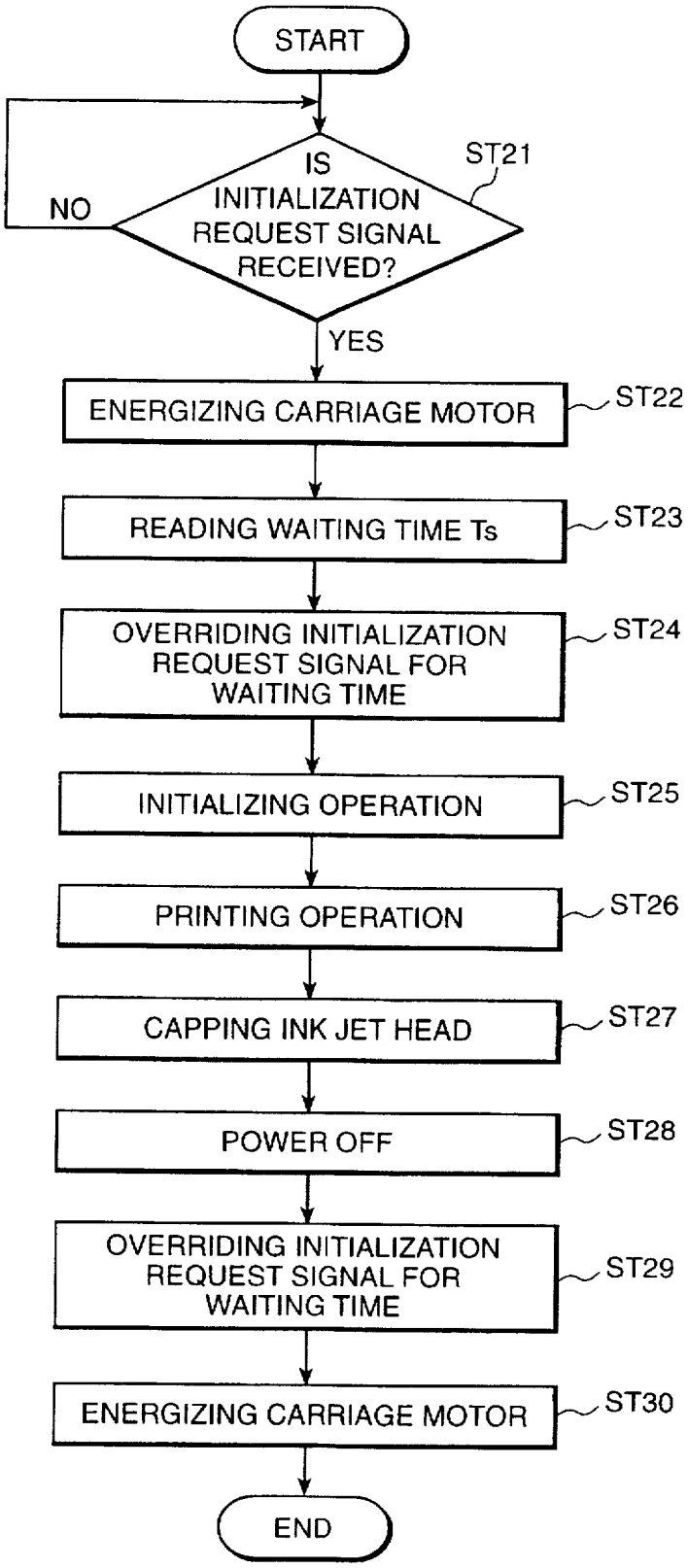
FIG. 5 is a flowchart of an operation by the printer shown in FIG. 4.

An operation of the above-described embodiment will now be described with reference to FIG. 5. Initialization request signal SI is issued at both timings at which main switch 27 is turned on and turned off.

As shown in FIG. 2, in the original state of printer 11, carriage 30 on which ink jet head 33 is mounted is located at a capping position, at which ink jet head 33 is capped with cap 31*a*.

Firstly, main switch 27 of computer 13 is turned on and initialization request signal SI is issued from computer 13 to printer 11 through initialization request signal transmission line 17. In this embodiment, power unit 29 of printer 11 generates a DC drive voltage in response to the operation of switch 27. When initialization request signal SI is received by printer 11 and CPU 55 identifies the signal SI, the YES-path is taken in step ST21. Otherwise, the NO-path is taken. In the next step ST22, a carriage motor (not shown) is energized. At this time, since the carriage motor is not rotated but only energized, a holding current flows through the carriage motor. Thus, some power consumption occurs in the carriage motor. After step ST22 is performed, the waiting time Ts is read out of memory area 57M of ROM 57 in step ST23. In step ST24, initialization request signal SI is overridden for the waiting time Ts. Thus, the initializing operation is inhibited for the waiting time Ts, or rather the initializing operation by printer 11 is not effected for the waiting time Ts. After the waiting time Ts is elapsed, the initializing operation is then carried out in step ST25. Cap 31*a* is removed from ink jet head 33 and ink jet head 33 is moved in the direction X1 so as to be located at the maintenance position. At the maintenance position, as stated before, ink is jetted from all of the nozzles of ink jet head 33 toward ink receiver 31*b*. After the maintenance operation is effected, carriage 30 with ink jet head 33 is moved in the reciprocal directions X1 and X2 shown in FIG. 2 and then carriage 30 is further moved to the standby position. Thus, the initializing operation by printer 11 is completed. During the reciprocating movement of carriage 30, predetermined constants and state flags are set in registers (not shown) of CPU 55. Upon receipt of print data PD from computer 13, printer 11 carries out a printing operation in step ST26. After the printing operation is completed, carriage 30 with ink jet head 33 is moved toward maintenance station 31. When ink jet head 33 faces against cap 31*a* at the capping position, ink jet head 33 is covered with cap 31*a* to avoid evaporation of ink in the nozzles of ink jet head 33 in step ST27. After that, main switch 27 of computer 13 is turned off, and the electric power supplied to power unit 29 of printer 11 is also stopped in step ST28. However, DC drive voltage is kept for the attenuating period by the capacity of a condenser of power unit 29, as stated above. During this period, control section 51 of printer 11 receives the initialization request signal SI when the initializatin request signal SI is outputted from computer 11. However, in this embodiment, the initialization request signal SI from computer 11 is overridden for the waiting time Ts in step ST29. The initializing operation by printer 11 is inhibited and thus is not carried out for waiting time Ts. During the waiting time Ts, the carriage motor is energized with a holding current from the DC power unit 29 (step ST30), and the DC drive voltage is consumed completely by the energizing operation of the carriage motor, as stated above. Thus, when the waiting time Ts has elapsed, the DC drive voltage from power unit 29 is decreased to substantially zero. Thus, the initializing operation by printer 11 is not performed when the electric power of computer 13 is turned off. Ink jet head 33 is kept at the capping position and clogging of head 33 does not occur. In addition, carriage 30 is also kept at its position and an operator or a user does not perceive erroneously that some trouble is occurring in the printer because of the unexpected movement of carriage 30 when main switch 27 of computer 13 is turned off.

According to the above-described embodiment, since the energizing operation of the carriage motor is carried out when the initialization request signal SI is received by printer 11, the standby state of the carriage motor (carriage) can be established faster than that of a conventional printer when the DC power unit 29 is activated. In addition, since the DC drive voltage from power unit 29 of printer 11 is rapidly decreased by the performance of the energizing operation when the DC power unit 29 is deactivated in response to the power off operation of the external host apparatus, it can be assured that the initializing operation is inhibited for the waiting time Ts when the initialization request signal SI is received by printer 11.

In the above-described embodiment, the electric power (power unit 29) of printer 11 is controlled by main switch 27 which controls the electric power of computer 13. However, the present invention may be applied to printers whose electric power is respectively controlled by a switch different from main switch 27 of computer 13. In this case, the initialization request signal SI is overridden by printer 11 even if the electric power of printer 11 is on and the electric power of computer 13 is being turned off. Thus, a useless initializing operation by printer 11 can be avoided when the electric power of the computer 13 is turned off and an undesirable ink jetting (ink consumption) by ink jet head 33 of printer 11 can also be eliminated.

The present invention has been described with respect to a specific embodiment. However, other embodiments based on the principles of the present invention should be obvious to those of ordinary skill in the art. Such embodiments are intended to be covered by the claims.

What is claimed is:

1. A serial printer which performs an initializing operation in response to an initialization request signal fed from an external host apparatus, the printer comprising;

printing means, having a carriage motor, for carrying a print head disposed on a carriage, to perform a printing operation;

a DC power unit for providing a DC drive voltage to the carriage motor, the DC power unit having an attenuating period of the DC drive voltage when the DC power unit is deactivated; and control means for performing the initializing operation in which the carriage is moved in reciprocal directions after a waiting time corresponding to the attenuating period has elapsed when the initialization request signal from the host apparatus is received by the printer.

2. A printer according to claim 1, wherein the control means includes a memory in which the waiting time has been stored.

3. A printer according to claim 2, wherein the control means further includes means for reading the waiting time from the memory when the initialization request signal from the host apparatus is received by the printer.

4. A printer according to claim 3, wherein the control means includes means for energizing the carriage motor with a holding current from the DC power unit during the waiting time when the initialization request signal is received by the printer.

5. A printer according to claim 4, wherein the energizing means decreases the attenuating period when the DC power unit is deactivated.

6. A printer according to claim 4, wherein the energizing means causes the printing means to start the printing operation smoothly when the DC power unit is activated.

7. A serial printer which performs an initializing operation in response to an initialization request signal fed from an external host apparatus, the printer comprising;

an ink jet print head, having a plurality of orifices, for jetting ink from the orifices onto a print medium based on a print data from the host apparatus;

carriage means, having a carriage motor, for carrying the ink jet print head in reciprocal directions;

a DC power unit for providing a DC drive voltage to the carriage motor, the DC power unit having an attenuating period of the DC drive voltage when the DC power unit is deactivated;

cap means for capping the plurality of orifices of the ink jet print head when the ink jet print head is located at a capping position; and control means for controlling the operation of the carriage means and the ink jet print head, the control means including means for performing the initializing operation, in which the ink jet print head is located at a maintenance position and ink is jetted from all of the plurality of orifices of the ink jet print head, after a waiting time corresponding to the attenuating period has elapsed when the initialization request signal from the host apparatus is received by the printer.

8. A printer according to claim 7, wherein the control means includes means for driving the carriage means in the reciprocal directions at a given timing during performance of the initializing operation.

9. A printer according to claim 7, wherein the control means includes a memory in which the waiting time has been stored.

10. A printer according to claim 9, wherein the control means also includes means for reading the waiting time from the memory when the initialization request signal from the host apparatus is received by the printer.

11. A printer according to claim 10, wherein the control means includes means for overriding the initialization request signal from the host apparatus for the waiting time when the initialization request signal is received by the printer.

12. A printer according to claim 7, wherein the control means includes means for energizing the carriage motor with a holding current from the DC power unit for the waiting time when the initialization request signal is received by the printer.

13. A printer according to claim 12, wherein the energizing means decreases the attenuating period when the DC power unit is deactivated.

14. A printer according to claim 13, wherein the energizing means causes the printing means to start the printing operation smoothly when the DC power unit is activated.

15. A serial printer which performs an initializing operation in response to an initialization request signal fed from an external host apparatus, the printer comprising;

printing means, having a carriage motor, for carrying a print head to perform a printing operation;

a DC power unit for providing a DC drive voltage to drive the carriage motor, the DC power unit having an attenuating period of the DC drive voltage when the DC power unit is deactivated; and control means for overriding the initialization request signal from the host apparatus for a waiting time corresponding to the attenuating period so that the initializing operation by the printer is inhibited for the waiting time.

16. A printer according to claim 15 further including an interface for receiving the initialization request signal from the host apparatus when the host apparatus is deactivated, the DC power unit being deactivated through the host apparatus when the host apparatus is deactivated.

17. A printer according to claim 16, wherein the control means includes a memory in which the waiting time has been stored.

18. A printer according to claim 17, wherein the control means further includes means for reading the waiting time from the memory when the initialization request signal from the host apparatus is received by the printer.

* * * * *

UNITED STATES PATENT AND TRADEMARK OFFICE

CERTIFICATE OF CORRECTION

PATENT NO. : 5,784,080

DATED : July 21, 1998

INVENTOR(S) : NITTA et al

It is certified that error appears in the above-identified patent and that said Letters Patent is hereby corrected as shown below:

On the title page, item

[73] Assignee: Please change "Kabushiki Kaisha Tec" to --Kabushiki Kaisha TEC--

Signed and Sealed this

Sixteenth Day of February, 1999

*Attest:*

*Acting Commissioner of Patents and Trademarks*

*Attesting Officer*